United States Patent [19]

Murray et al.

[11] 4,010,097

[45] Mar. 1, 1977

[54] PNEUMATIC CLASSIFIER FOR REFUSE MATERIAL WITH DOUBLE VORTEX AIRFLOW

[75] Inventors: Donald L. Murray, Greenfield; John N. Lees, Jr., Wauwatosa; Frank W. Toman, Jr., Milwaukee, all of Wis.

[73] Assignee: Allis-Chalmers Corporation, Milwaukee, Wis.

[22] Filed: Oct. 9, 1975

[21] Appl. No.: 621,226

[52] U.S. Cl. ..... 209/139 R; 209/149; 209/154

[51] Int. Cl.[2] ..... B07B 4/02; B07B 11/04

[58] Field of Search ..... 209/138–139 R, 209/140, 141, 149, 154, 26–29, 34–37

[56] References Cited

UNITED STATES PATENTS

| | | | |
|---|---|---|---|
| 1,188,323 | 6/1916 | Richardson | 209/138 X |
| 2,144,418 | 1/1939 | Schramm | 209/139 R |
| 2,203,959 | 6/1940 | Hammack | 209/138 X |
| 2,257,552 | 9/1941 | Hammack | 209/139 R |
| 3,219,185 | 11/1965 | Doyle | 209/139 R |
| 3,655,043 | 4/1972 | Wochnowski et al. | 209/154 X |

*Primary Examiner*—Frank W. Lutter
*Assistant Examiner*—Ralph J. Hill
*Attorney, Agent, or Firm*—Arthur M. Streich

[57] ABSTRACT

An apparatus and operation is disclosed in which light solids material such as shredded paper passes from an upper end of a column and heavier material such as glass and metal particles drop from a lower end of the column. The column includes an air locked feed chute having a downwardly inclined material feeding surface, that opens intermediate the column ends into a stream of air moving upwardly in the column, for admitting mixed light and heavy particles of refuse material to the air stream. A zone of expanded volume is provided at the level where the column and the chute come together and this zone extends upwardly from the material feeding surface and terminates at a level below the upper end of the column where column cross section area is less than beneath the expanded zone. Air drawn upwardly through the column from the lower end and reaching the expanded zone, turns toward the material feeding chute and forms a recirculation zone, herein called a first vortex, within the zone about an axis parallel to and above the intersection of the material feeding surface of the chute with wall structure of the column, before resuming upward flow. A baffle is pivotally journalled in the lower end of the column to pivot about an axis beneath and parallel to the horizontal intersection of the chute with a flat wall structure of the column. The baffle is supported to be pivotable within a range of angularly disposed positions transverse to both a horizontal and a vertical plane through the pivotal axis. Within such range of positions air passing upwardly and over the baffle will be turned to form a second recirculation zone, herein called a second vortex, about and parallel to and beneath the first vortex and pivoting the baffle provides a control of the air flow characteristics created and the separation characteristics of material introduced through the chute.

6 Claims, 3 Drawing Figures

PNEUMATIC CLASSIFIER FOR REFUSE MATERIAL WITH DOUBLE VORTEX AIRFLOW

BACKGROUND OF THE INVENTION

1. Field of the Invention

This invention relates to a pneumatic apparatus for classifying particles of refuse material and the like, to separate relatively light and heavy particles. In particular, this invention relates to a column classifier through which air is drawn from bottom to top and which has an air locked feed chute that opens into the column intermediate the top and bottom, for admitting mixed light and heavy particles to the rising air stream, with the heavier particles dropping from the column while lighter particles are carried upwardly in the air stream.

2. Description of the Prior Art

Pneumatic devices for classifying and separating solid particles in an apparatus that includes a column with a stream of air rising therethrough, are known to the prior art. To facilitate describing the distinguishing features of the present invention from the prior devices, such prior devices can be categorized as comprising two types. A first type includes a column in which mixed solids are dropped into the top of the column in which a stream of air is rising; and a second type includes a column in which mixed solids are fed at an intermediate elevation into the column in which air is rising.

Examples of apparatus of the first type appear in U.S. Pat. Nos. 1,365,884 of Aug. 21, 1923, 1,650,727 of Nov. 29, 1927; 1,787,759 of Jan. 6, 1931; and 3,833,117 of Sept. 3, 1974.

Examples of the second type appear in U.S. Pat. Nos. 2,968,400 of Jan. 17, 1961; 3,265,210 of Aug. 9, 1966; and 3,441,131 of Apr. 29, 1969.

As will appear from the description to follow, the present invention relates to the aforesaid second type and has for its object the location and utilization of a baffle which is pivotal to control air flow characteristics to provide an improved control effect upon separation characteristics in that type of classifier-separator. In such regard, it should be noted that among the prior patents referred to and related to both types, are disclosures of pivotal baffle-like devices at locations and for purposes other than as shall be hereinafter described and claimed. For example, in U.S. Pat. No. 1,465,884, a pivotal damper is provided to control an air inlet opening into one side of the lower end of a solids separating column; in U.S. Pat. No. 1,787,759 a pair of relativel pivotal plates are used to control air inflow to a particle separator; and in U.S. Pat. No. 2,968,400 a pivotal plate adjustably directs a generally horizontal flow of air and light particles through a drop-out chamber after heavy particles have dropped out in a vertical chamber. In addition, applicants are aware that devices of the aforesaid second type have been built with a pivotal plate controlling the flow of air drawn upwardly of a mid-column level at which solids are injected into the air stream.

None of the aforesaid practices of the prior art have involved a pivotal baffle located to operate in the manner that will be described with regard to the present invention.

SUMMARY OF THE INVENTION

It has hereinbefore been stated that the present invention relates to a type of classifier-separator in which mixed solids are fed through a chute at an intermediate elevation into a column in which air is rising and that the object of the present invention involves the location and utilization of a baffle which is pivotal to control air flow characteristics to provide an improved control effect upon particle separation characteristics which results in relatively heavy particles dropping through the column and relatively light particles being carried upwardly and out of the column in the air stream.

According to the present invention, such a baffle is pivotally journalled in the lower end of the column to pivot about a horizontal axis beneath and parallel to the intersection of the chute with a flat vertical wall of the column. The baffle is supported to be pivotable with range of angularly disposed position transverse to both a horizontal and a vertical plane through the pivotal axis. The chute is provided with an air lock feeder on the end of the chute remote from the column and a material feeding surface of the chute feeds mixed size solids from the air lock feeder into the rising stream of air. Air drawn upwardly through the column from the lower end and reaching an expanded zone where the chute and column come together, turns toward the material feeding chute and forms a first recirculation zone, herein called a first vortex, about a generally horizontal axis within the expanded zone before resuming upward flow. Within the range of the positions in which the baffle can be disposed, air passing upwardly over the baffle will be turned to form a second recirculation zone, herein called a second vortex, about an axis parallel to and beneath the first vortex, and pivoting the baffle provides a control of the air flow characteristics created and the separation characteristics of material introduced through the chute.

Other features and objects of the invention that have been attained will appear from the more detailed description to follow with reference to an embodiment of the present invention shown in the accompanying drawing.

DESCRIPTION OF THE PREFERRED EMBODIMENT

Figure 1:
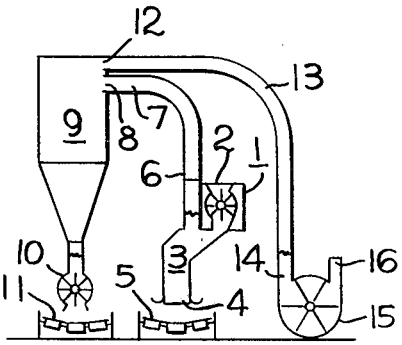
FIG. 1 of the accompanying drawing shows diagrammatically an arrangement of a system including a side elevation, partly in section, a classifier-separator according to the present invention.

Referring to FIG. 1 of the drawing, a system arrangement is shown in which an apparatus according to the present invention may be used for classifying particles of refuse material and the like to separate relatively light and relatively heavy solid particles. FIG. 1 discloses a classifier-separator 1 having an inlet 2 for admitting mixed light and heavy solids to a column 3. A lower end 4 of column 3 is open for drawing air into column 3 and dropping heavier particles from column 3 to a conveyor 5. An upper end 6 of column 3 is connected by a conduit 7 to an inlet 8 of a cyclone separator 9. The cyclone separator 9 may be of the usual design and construction in which air and entrained light particles are admitted tangentially to the separator and directed in a cyclonic path during which the particles are thrown outwardly by centrifugal force and drop down to a star wheel discharging device 10 which discharges the light particles to a conveyor 11. Air from which the light particles have been thusly removed, passes out through an outlet 12 and through a conduit 13 to an inlet 14 of a blower 15. Blower 15 draws air through the system, with the air entering the lower end 4 of column 3 and passing through column 3, conduit 7, cyclone separator 9, conduit 13 to blower 15 from which the clean air is discharged through an outlet 16 to atmosphere.

Figure 2:
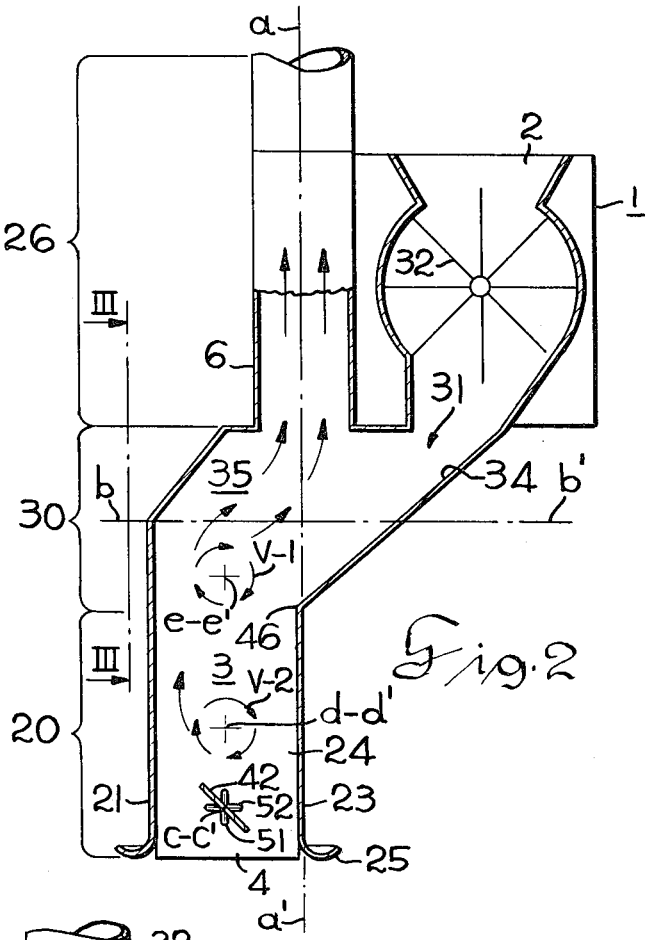
FIG. 2 is a side elevation, in section, of the classifier-separator to enlarged scale.
Figure 3:
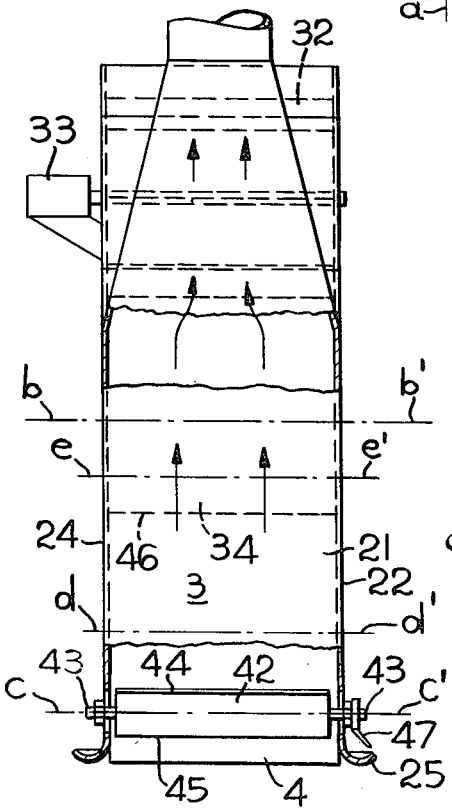
FIG. 3 is a view taken along line III—III in FIG. 2 and viewing the structure in the direction indicated by arrows.

The construction and operation of the classifier-separator 1 will now be described in detail with reference to FIGS. 2 and 3. As shown in FIG. 2, the column 3 comprises a lower rectangular portion 20 made up of walls 21–24 which define the open lower end 4, and the lower edges of these walls have upwardly curved lips 25 to provide a smooth flow of air into the portion 20. An upper column portion 26 comprises a transition piece 6 which on its upper end defines the column outlet end, and which is arranged with a central vertical axis *a–a'* (FIG. 2) therethrough located in the vertical plane of wall 23 of the lower column portion 20.

Between the lower portion 20 and the upper portion 26 is a midportion 30 which will now be described with reference to FIG. 2. At the level of the midportion 30, a chute 31 is arranged in communication with the material inlet 2 and opens into midportion 30. An air lock feeder 32 which may be driven by such as an electric motor 33 mounted as shown in FIG. 3, is provided between the material inlet 2 and the upper end of chute 31, as shown in FIG. 2. The chute 31 is itself provided with a downwardly inclined material feeding surface 34 from the air lock feeder 32 to the midportion 30 of column 3, with a downward slope that defines an angle of preferably about 120 degrees with wall 23. The chute 31 and its surface 34 thus cooperate with wall surfaces projecting upwardly from the lower portion 20 of column 3 to define a zone 35 of expanded column volume with the midportion 30, with the expanded volume zone 35 having a cross-sectional area at the level of a horizontal plane *b–b'* that is greater than adjacent zones defined within the portions 26 and 20, which are respectively above and below the expanded zone in midportion 30.

Within the lower portion 20 of the column 3, a baffle 42 having projecting journals 43 (see FIG. 3) journalled in walls 22, 24 along a horizontal axis *c–c'*. The journal 43 and journal axis *c–c'* are located approximately midway between edges 44, 45 which are parallel to journal axis *c–c'*. As shown in FIG. 2, axis *c–c'* is spaced upwardly of the curved lips 25 at the lower end 4 of column 3, and below an edge 46 formed by the intersection of the surface 34 of chute 31 with the wall 23 of column 3. The edge intersection 46 is horizontal, and the journal axis *c–c'* is parallel to the edge intersection 46. An actuating mechanism is connected to the baffle 42 and may comprise, as shown in FIG. 3, a simple handle 47 attached to one of the journals 43 such as the journal 43 projecting from wall 22, for pivoting the airfoil 42 about the axis *c–c'*. The handle 47 and baffle 42 may be secured in any selected angular position by a suitable device (not shown) which may be chosen from any of the well-known devices such as, for example, are shown in the Engineers' Illustrated Thesaurus (by H. Herkimer, Chemical Publishing Co. of New York, 1952) at Section I-3e-E or Section II-12a-K or M. The baffle 42 may also be moved vertically or horizontally by sliding the journals 43 in vertical wall slots 51 or horizontal wall slots 52 (see FIG. 2). The journals 43 may be secured in selected positions in slots 51 or 52 by turning the nuts on journals 43 (as shown in FIG. 3) to frictionally engage sidewalls 22 and 24, respectively.

In the operation of the described system and apparatus according to the present invention, fan 15 (in FIG. 1) draws air through conduit 13, cyclone 9, conduit 7, column 3 and hence atmospheric air into the lower end 4 of column 3. Mixed size particles of such a refuse material enter inlet 2 and are fed by the air lock feeder 32 into chute 31. Such material slides and tumbles down the surface 34 of chute 31 and into the air stream rising through the column 3. Some of the heavier particles drop immediately onto conveyor 5 while other particles are carried upwardly in the rising air stream. Such air and entrained particles reach the expanded zone 35 defined by the midportion 30 of column 3 and chute 31. At this level, the air stream turns toward the chute 31 because of reduced resistance to airflow by the substantial expansion of the enclosed volume. That is, it is the chute 31 that expands the enclosed volume at that level and so the air stream turns toward the chute. This movement combined with the orientation of the upper column portion 26, also toward the chute 31, results in the formation of a first vortex V-1 about a horizontal axis *e–e'* before the air stream resumes its upward flow, as indicated by arrows in FIG. 2. Turning the handle 47 to position the baffle 42 transverse to both a horizontal plane and a vertical plane passing through the journal axis *c–c'*, as shown in FIG. 2, turns the rising air stream passing over the baffle 42, to form a second vortex V-2 about an axis *d–d'* parallel to and above journal axis *c–c'*, and parallel to and below the axis *e–'* of the first vortex v-1. The positioning of baffle 42 to form the second vortex V-2 may be done manually by an operator turning handle 47 or by the actuation of suitable remote control devices (not shown), until the desired change in air flow characteristics (e.g., violence, magnitude of turbulence etc.) and the desired change separating characteristics, as determined by visually observing particle dropout on conveyor 5, is achieved. By such control an operator can, for example, cause more agglomerations of bits of paper to be broken up by collisions with other agglomerates, after which the bits are carried up column 3 rather than having such agglomerates dropped to conveyor 5. Both the existence of the vortex V-1 and vortex V-2, and an air flow pattern that is variable and controllable with attendant effect upon separation characteristics, by pivoting the baffle 42 in the manner described, have been confirmed by observing the path followed by bits of shredded paper and other observable particles in feed material fed to the apparatus as described. Since the nature of incoming material and its condition (e.g., moisture content) will not always be the same, the most desirable position for baffle 42 will not always be the same.

Particles retained in the rising air stream as it passes from column 3 to the cyclone separator 9, drop from the air stream in separator 9 and are discharged through the star wheel 10 to conveyor 11 while the air stream which is now clean of refuse material passes through fan 15 to atmosphere.

From the foregoing detailed description of the present invention, it has been shown how the objects of the present invention have been attained in a preferred manner. However, modifications and equivalents of the disclosed concepts such as readily occur to those skilled in the art are intended to be included in the scope of this invention. Thus, the scope of the invention is intended to be limited only by the scope of the claims such as are or may hereafter be, appended hereto.

The embodiments of the invention in which an exclusive property or privilege is claimed are defined as follows:

1. An apparatus for classifying particles of refuse material and the like to separate relatively light and heavy solids and having a column, means connected to the upper end of the column for drawing a stream of air into the lower end of the column and upwardly through the column, a chute that opens into the column intermediate the column ends and having an air lock feeder with a downwardly inclined material feeding surface from the air lock feeder to the column for admitting mixed light and heavy solids particles, the chute cooperating with the column to define a zone of expanded column volume and in which air drawn upwardly turns toward the chute and forms a vortex before resuming upward flow and including an improvement which comprises:

a. a baffle pivotally journalled in the lower end of the column below an intersection of the feed chute and the column, about a journal axis disposed in a generally horizontal plane; and b. An actuating mechanism connected to the baffle and operative to pivot the airfoil about the general horizontal journal axis, whereby air drawn upwardly through the column from the lower end and passing upwardly over the baffle, turns to form a second vortex beneath the first vortex and pivoting the baffle about its journal axis provides a control of turbulence created by the second vortex and the separation characteristics of material introduced through the chute which result in heavier particles dropping from the column while lighter particles are carried upwardly in the air stream.

2. An apparatus according to claim 1 in which the portion of the column below the expanded zone is rectangular in horizontal cross section, the chute intersects a vertical wall surface of the column with the intersection being in a generally horizontal plane, and the journal axis of the baffle is parallel to the intersection between the chute and column wall, to thereby turn the rising air stream to form the second vortex about a horizontal central axis parallel to the central axis of the first vortex.

3. An apparatus according to claim 2 in which the pivotally journalled baffle is supported by journals projecting through openings in opposite wall surfaces of the lower end of the column and with such journals being movably secured within the openings in said wall surfaces for selectively positioning the journals in a vertical plane.

4. An apparatus according to claim 2 in which the pivotally journalled baffle is supported by journals projecting through openings in opposite wall surfaces of the lower end of the column and with such journals being movably secured within the openings in the wall surfaces for selectively positioning the journals in a horizontal plane.

5. An apparatus according to claim 1 in which the baffle is generally rectangular and is supported to be pivotable within a range of angularly disposed positions transverse to both a horizontal and a vertical plane through the pivotal axis.

6. An apparatus according to claim 5 in which the baffle journal axis is midway between the edges of the baffle parallel to the journal axis.

* * * * *